US007946463B2

(12) United States Patent
Moeller

(10) Patent No.: US 7,946,463 B2
(45) Date of Patent: May 24, 2011

(54) ONE WAY VALVE FOR COMBUSTION TOOL FAN MOTOR

(75) Inventor: Larry Moeller, Schaumburg, IL (US)

(73) Assignee: Illinois Tool Works Inc., Glenview, IL (US)

( * ) Notice: Subject to any disclaimer, the term of this patent is extended or adjusted under 35 U.S.C. 154(b) by 163 days.

(21) Appl. No.: 12/093,879

(22) PCT Filed: Oct. 6, 2006

(86) PCT No.: PCT/US2006/039142

§ 371 (c)(1),
(2), (4) Date: Aug. 12, 2008

(87) PCT Pub. No.: WO2007/058713

PCT Pub. Date: May 24, 2007

(65) Prior Publication Data

US 2009/0321493 A1 Dec. 31, 2009

Related U.S. Application Data

(60) Provisional application No. 60/736,704, filed on Nov. 15, 2005.

(51) Int. Cl.
*B25C 1/04* (2006.01)

(52) U.S. Cl. ..... 227/9; 123/46 SC

(58) Field of Classification Search ..... 227/9, 10, 227/156, 129, 130, 139; 123/46 SC, 46 R, 123/46 H See application file for complete search history.

(56) References Cited

U.S. PATENT DOCUMENTS

| | | | | |
|---|---|---|---|---|
| 4,403,722 | A * | 9/1983 | Nikolich | 227/8 |
| 4,483,473 | A | 11/1984 | Wagdy | |
| 4,522,162 | A | 6/1985 | Nikolich | |
| RE32,452 | E * | 7/1987 | Nikolich | 123/46 SC |
| 4,717,060 | A * | 1/1988 | Cotta | 227/10 |
| 4,721,240 | A * | 1/1988 | Cotta | 227/10 |
| 4,739,915 | A * | 4/1988 | Cotta | 227/10 |
| 4,773,581 | A * | 9/1988 | Ohtsu et al. | 227/10 |
| 5,197,646 | A | 3/1993 | Nikolich | |
| 5,207,143 | A * | 5/1993 | Monacelli | 91/442 |
| 5,263,439 | A | 11/1993 | Doherty et al. | |
| 5,713,313 | A | 2/1998 | Berry | |
| 6,520,397 | B1 | 2/2003 | Moeller | |
| 6,619,527 | B1 | 9/2003 | Moeller | |
| 6,722,549 | B2 | 4/2004 | Shkolnikov et al. | |
| 6,755,159 | B1 * | 6/2004 | Adams et al. | 123/46 R |
| 6,786,379 | B2 * | 9/2004 | Largo | 227/10 |
| 7,073,468 | B2 | 7/2006 | Akiba et al. | |
| 2002/0020374 | A1 * | 2/2002 | Buchel et al. | 123/90.15 |

(Continued)

FOREIGN PATENT DOCUMENTS

DE 20 2005 011 723 U1 10/2005

(Continued)

*Primary Examiner* — Paul R Durand
(74) *Attorney, Agent, or Firm* — Greer, Burns & Crain, Ltd.

(57) ABSTRACT

A combustion nailer (10) having a combustion power source (14) defining a fan motor chamber (50) having at least one chamber wall (52, 54) and a motor shaft hole (56). A fan motor (44) is disposed in the fan motor chamber (50) and has a motor shaft (42) projecting through the motor shaft hole (56). A one way valve (60) is associated with the chamber (18) and the motor and is configured for allowing unidirectional airflow through the hole (56) past the motor (44), and preventing airflow in the opposite direction.

14 Claims, 3 Drawing Sheets

U.S. PATENT DOCUMENTS

2003/0127238 A1* 7/2003 Largo ..... 173/200
2004/0050901 A1 3/2004 Turk
2004/0238588 A1* 12/2004 Oda et al. ..... 227/10
2005/0000711 A1* 1/2005 Hurlstone et al. ..... 173/19
2005/0098123 A1* 5/2005 Miyata et al. ..... 123/46 SC
2005/0229598 A1 10/2005 Akiba et al.
2006/0006207 A1 1/2006 Akiba et al.
2006/0225674 A1* 10/2006 Ohtsu et al. ..... 123/46 H
2009/0321493 A1* 12/2009 Moeller ..... 227/9

FOREIGN PATENT DOCUMENTS

EP 251684 A1 * 1/1988

* cited by examiner

ONE WAY VALVE FOR COMBUSTION TOOL FAN MOTOR

RELATED APPLICATION

The present application claims priority under 35 USC §119 (e) from U.S. Ser. No. 60/736,704 filed Nov. 15, 2005.

BACKGROUND

The present invention relates generally to fastener-driving tools used for driving fasteners into workpieces, and specifically to combustion-powered fastener-driving tools, also referred to as combustion tools or combustion nailers.

Combustion nailers are known in the art for driving fasteners into workpieces, and examples are described in commonly assigned patents to Nikolich U.S. Pat. Re. No. 32,452, and U.S. Pat. Nos. 4,522,162; 4,483,473; 4,483,474; 4,403,722; 5,197,646; 5,263,439 and 5,713,313, all of which are incorporated by reference herein. Similar combustion-powered nail and staple driving tools are available commercially from ITW-Paslode of Vernon Hills, Ill. under the IMPULSE® and PASLODE® brands.

Such nailers incorporate a housing enclosing a small internal combustion engine or power source. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. Such ancillary processes include: mixing the fuel and air within the chamber, turbulence to increase the combustion process, scavenging combustion by-products with fresh air, and cooling the engine. The engine includes a reciprocating piston with an elongated, rigid driver blade disposed within a cylinder body.

A valve sleeve is axially reciprocable about the cylinder and, through a linkage, moves to close the combustion chamber when a work contact element at the end of the linkage is pressed against a workpiece. This pressing action also triggers a fuel-metering valve to introduce a specified volume of fuel into the closed combustion chamber.

Upon the pulling of a trigger switch, which causes the spark to ignite a charge of gas in the combustion chamber of the engine, the combined piston and driver blade is forced downward to impact a positioned fastener and drive it into the workpiece. The piston then returns to its original or pre-firing position, through differential gas pressures created by cooling of residual combustion gases within the cylinder. Fasteners are fed magazine-style into the nosepiece, where they are held in a properly positioned orientation for receiving the impact of the driver blade.

The cooling fan motor is housed in the cylinder head of the tool, and the fan blade is attached to a fan motor shaft, which passes through a hole in the cylinder head. It is preferred that the clearance between an inside diameter of the hole and the motor shaft outer diameter is kept to a minimum to prevent the unwanted leakage of combustion pressures during the drive stroke to increase tool power. At the same time, the shaft needs to freely rotate for proper fan operation, slide axially relative to the cylinder head to absorb impact forces generated in combustion, and avoid frequent contact with the edges defining the hole. The latter problem can result in hole widening or unwanted noise generated during operation.

Since the piston return cycle is relatively long, 5 to 10 times the duration of the power stroke, and relatively low pressures are used for piston return, less than −5 psi (gage) compared to greater than 85 psi (gage) during combustion, it is a goal of tool designers to conserve pressure escapement through the clearance area between the motor shaft and the hole. If pressure loss is substantial enough, at best, piston return times will increase, and at worst, the piston may not return. If piston return times are longer than the time it takes for the operator to open the combustion chamber to atmospheric pressures, piston return will cease and no nail will subsequently be driven.

Another design consideration of such nailers is that it is preferable for managing motor shock and displacement to allow venting between the motor and the cylinder head during the drive stroke. Venting prevents combustion pressures from acting on the motor surfaces that urge the motor outboard of the tool.

Therefore, there is a need for an improved combustion nailer which addresses the above-identified design parameters, including maintaining venting around the motor during the drive stroke, and preventing or minimizing leak paths during the piston return cycle.

BRIEF SUMMARY OF THE INVENTION

The above-listed needs are met or exceeded by the present one way valve for combustion tool fan motor. In the present tool, a sealing check-valve or one way valve is provided between the motor and the associated motor chamber in the cylinder head. The valve allows venting around the motor, or between the motor and the motor chamber wall during positive combustion-induced pressures in the combustion chamber, but prevents or minimizes leakage during negative, post-combustion pressures in the combustion chamber. In the preferred embodiment, the present valve is preferably made of a symmetrical design that is placed in the motor chamber prior to installation of the motor. Most preferably, the present valve is provided as a ring with peripheral lip seal forming the one way seal. Upon installation of the motor, the valve is trapped sandwich-style between the motor and the motor chamber and is operational.

In the preferred embodiment, the one way valve is provided with a lip seal configuration to avoid axial loading sufficient to disrupt the functional characteristics of the motor suspension. Additionally, the seal does not contact the motor shaft, which would degrade motor performance. Further, the present one way valve optionally imparts dampening characteristics to the suspension to reduce overall motor travel, the number of oscillations and the transmitted shock.

More specifically, a combustion nailer includes a combustion power source defining a fan motor chamber having at least one chamber wall and a motor shaft hole. A fan motor is disposed in the fan motor chamber and has a motor shaft projecting through the motor shaft hole. A one way valve is associated with the chamber and the motor and is configured for allowing unidirectional air flow through the hole past the motor, and preventing air flow in the opposite direction.

In another embodiment, a combustion nailer includes a cylinder head defining a fan motor chamber with a side wall and a bottom wall defining a motor shaft hole. A fan motor is disposed in the chamber and has a motor shaft projecting through the hole. A one way valve is associated with the bottom wall and sealingly engages a lower end of the fan motor for permitting combustion-induced unidirectional air flow from the hole.

DETAILED DESCRIPTION OF THE INVENTION

Figure 1:
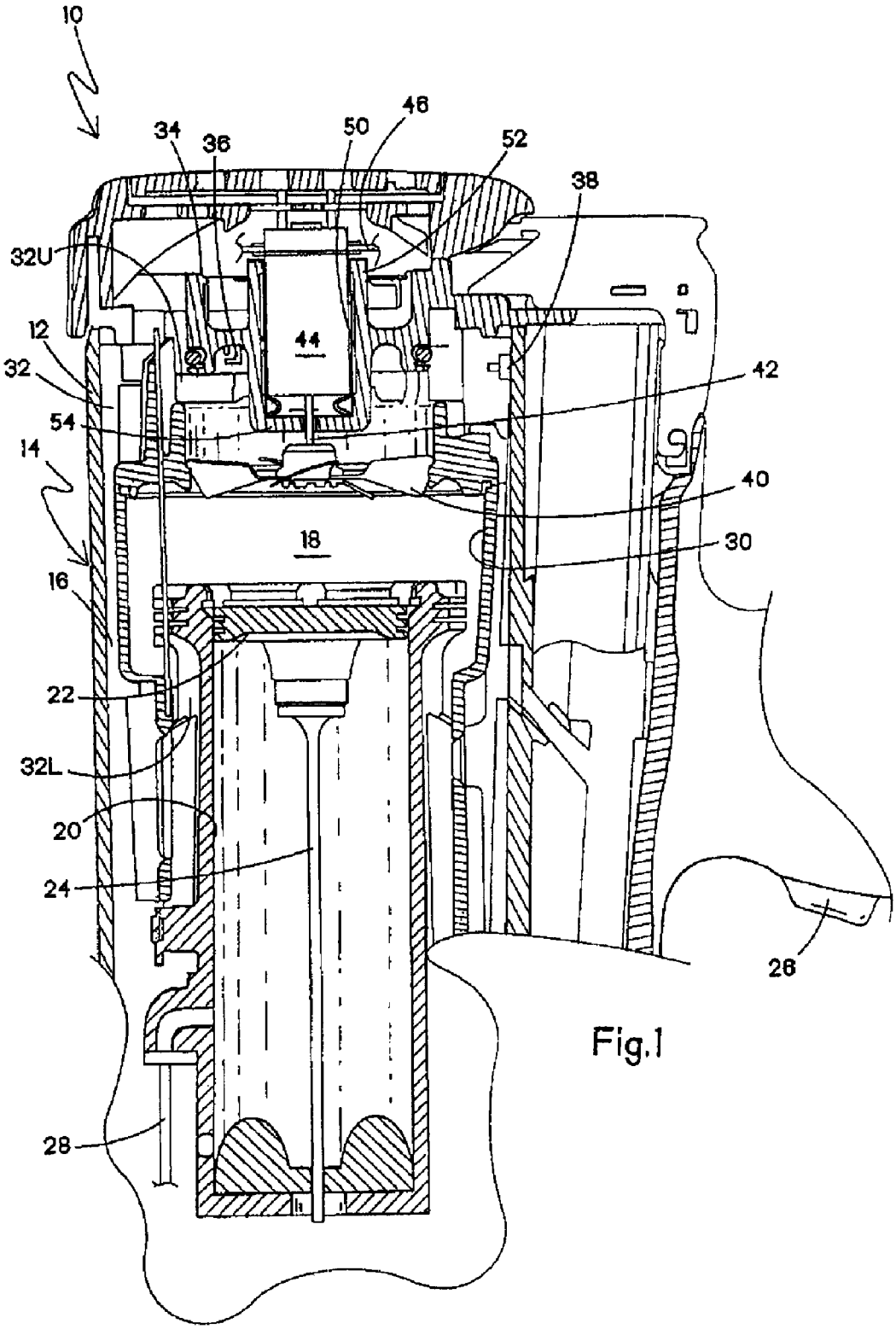
FIG. 1 is a fragmentary vertical section of a fastener-driving tool incorporating the present one way valve.

Referring now to FIG. 1, a combustion-powered fastener-driving tool, also known as a combustion nailer, incorporating the present control system is generally designated 10 and preferably is of the general type described in detail in the patents listed above and incorporated by reference in the present application. A housing 12 of the tool 10 encloses a self-contained internal power source 14 within a housing main chamber 16. As in conventional combustion tools, the power source or combustion engine 14 is powered by internal combustion and includes a combustion chamber 18 that communicates with a cylinder 20. A piston 22 reciprocally disposed within the cylinder 20 is connected to the upper end of a driver blade 24. As shown in FIG. 1, an upper limit of the reciprocal travel of the piston 22 is referred to as a pre-firing position, which occurs just prior to firing, where ignition of the combustion gases initiates the downward driving of the driver blade 24 to impact a fastener (not shown).

Depending on the selected operational mode, when the nailer 10 is in a sequential mode, through depression of a trigger 26 associated with a trigger switch (not shown, the terms trigger and trigger switch are used here interchangeably), an operator induces combustion within the combustion chamber 18, causing the driver blade 24 to be forcefully driven downward through a nosepiece (not shown). The nosepiece guides the driver blade 24 to strike a fastener that had been delivered into the nosepiece via a fastener magazine as is well known in the art.

Adjacent to the nosepiece is a workpiece contact element (not shown), which is connected through a linkage 28 (shown fragmentarily) to a reciprocating valve sleeve 30, which partially defines the combustion chamber 18. Depression of the tool housing 12 against a workpiece causes the workpiece contact element to move relative to the tool housing from a rest position to a pre-firing position. This movement overcomes the normally downward biased orientation of the workpiece contact element caused by a spring (not shown).

Through the linkage 28, the workpiece contact element is connected to and reciprocally moves with, the valve sleeve 30. In the rest position (FIG. 1), the combustion chamber 18 is not sealed, since there is an annular gap 32 including an upper gap 32U separating the valve sleeve 30 and a cylinder head 34, which accommodates a spark plug 36, and a lower gap 32L separating the valve sleeve 30 and the cylinder 20. A chamber switch 38 is located in proximity to the valve sleeve 30 to monitor its positioning. As is known in the combustion tool art, the chamber switch 38 closes in coordination with the trigger 26 to achieve ignition, and the sequence of the respective closing of these switches determines whether the tool is operating under is sequential or repetitive modes of operation.

Figure 2:
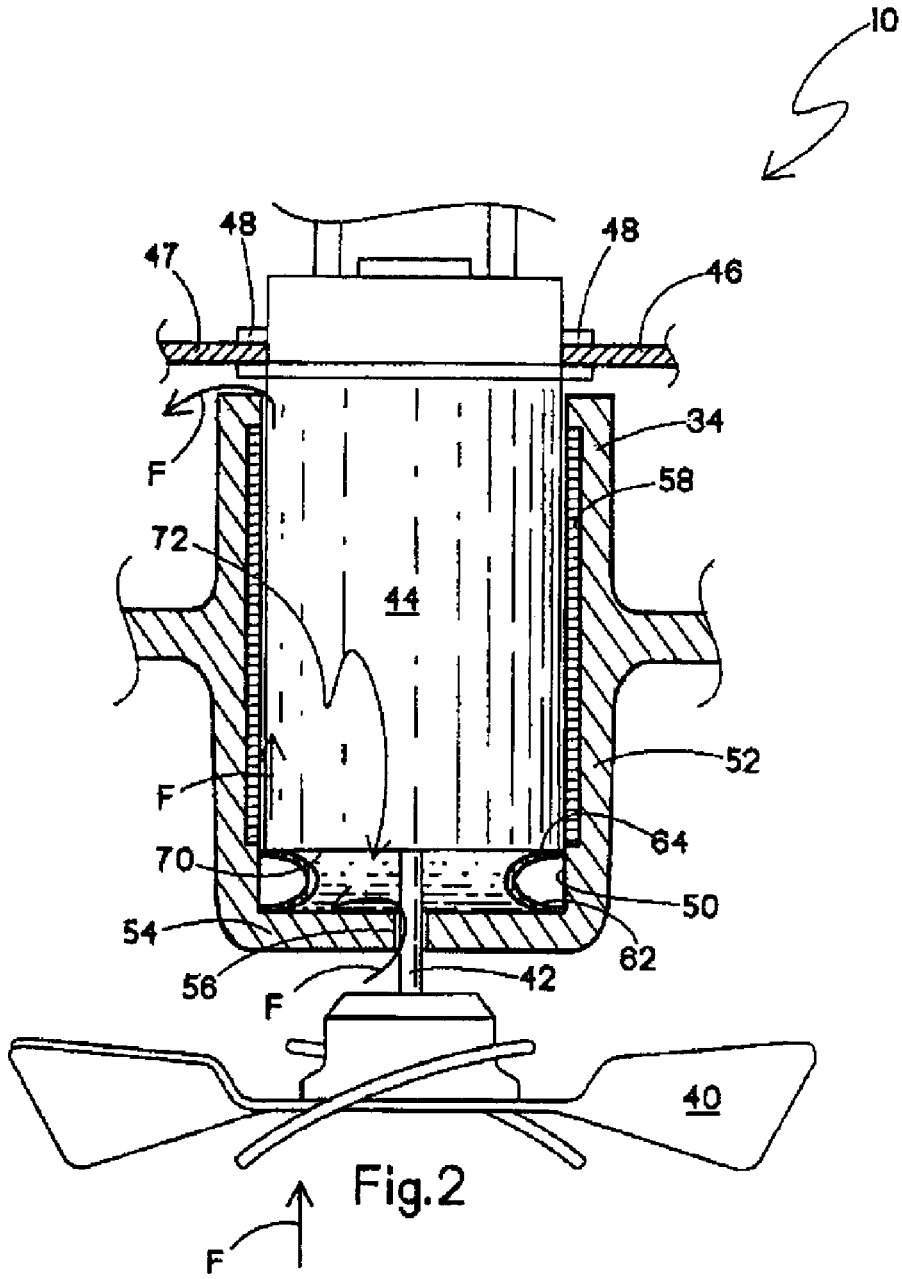
FIG. 2 is a fragmentary vertical cross-section of the fan motor chamber of the tool of FIG. 1 with the one way valve shown installed.

Referring now to FIGS. 1 and 2, in the preferred embodiment of the present tool 10, the cylinder head 34 also is the mounting point for at least one cooling fan 40 connected by a motor shaft 42 to an associated fan motor 44, the fan extends into the combustion chamber 18 as is known in the art and described in the patents which have been incorporated by reference above. The motor 44 is preferably suspended in relation to the cylinder head by a resilient suspension 46 (shown fragmentarily) which is designed to dampen combustion-induced shock impacts. Such suspensions are described in the patents listed above and incorporated by reference, and also in commonly-assigned U.S. Pat. Nos. 6,520,397 and 6,619,527, which are incorporated by reference. More specifically, the suspension 46 includes a plate or panel member 47 secured to the motor 44 as by clips 48, equivalent fasteners, brackets or the like, and resiliently connected to the cylinder head 34 by a rubber-like web and/or compressible bushings as described in the above-listed patents. Axial shock forces generated during the operation of the combustion engine 14 are dampened by the suspension 46 to reduce motor accelerations and oscillation.

As best seen in FIG. 2, the fan motor 44 is operationally oriented relative to the cylinder head 34 by being engaged in a fan motor chamber 50 defined by a generally cylindrical sidewall 52 circumscribing an axis of the fan motor 44, which is joined to a bottom wall 54 having a preferably centrally located motor shaft hole 56. While the fan motor chamber 50 is preferably unitary, as being cast with the cylinder head 34, its fabrication using additional components along with fasteners, welding or suitable chemical adhesives is also contemplated. The motor shaft hole 56 is preferably dimensioned to rotatably and slidably accommodate the motor shaft 42; however it has been found that the motor hole must be sufficiently larger than the outer diameter of the motor shaft to prevent the shaft from contacting the borders of the hole during operation.

Also provided in the fan motor chamber 50 is a sleeve liner 58 which is inlaid into the sidewall 52. The liner 58 is made of a non-corrosive, low friction material for guiding the motor in its axial motion relative to the fan motor chamber 50. Preferably, the sleeve liner 58 is vertically corrugated on an inner surface for providing guiding action while allowing sufficient gas flow from the motor shaft hole 56.

A main feature of the present invention is the provision of a one way valve 60 associated with the combustion chamber 18 and the fan motor 44 and configured for allowing unidirectional air flow through the motor shaft hole 56 and past the fan motor 44. In other words, during a combustion event, the gas pressure generated in the combustion chamber 18 is allowed to pass through the motor shaft hole 56 in the direction of arrows F (FIG. 2), but atmospheric air cannot flow back into the combustion chamber. Further explained, the reverse flow of air is prevented by the one way valve 60. This construction promotes the formation of a vacuum in the combustion power source 14, thus facilitating return of the piston 22, which is desired for continued tool operation. In addition, the valve 60 is configured for maintaining a sealing relationship with the fan motor 44 during sliding action of the motor relative to the fan motor chamber 50 through the action of the suspension 46. An effective alternate configuration allows for intermittent contact between the valve 60 and the fan motor 44 or the fan motor chamber 50 during the brief period that the dynamic axial shock displacement occurs.

Figure 3:
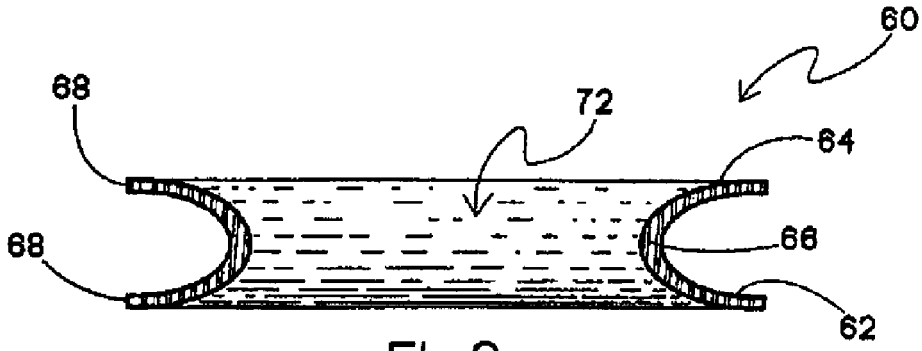
FIG. 3 is a vertical section of the preferred construction of the present valve.

Referring to FIGS. 2 and 3, more specifically, while any suitable type of check or other one-way valve is contemplated, in the preferred embodiment the one way valve 60 is an annular ring which circumscribes the motor shaft hole 56, is associated with the motor 44 and the fan motor chamber 50, and is constructed and arranged for allowing unidirectional air flow through the hole past the motor. Air flow in the reverse direction, toward the combustion chamber 18 from ambient, is prevented. While other locations are contemplated, in the preferred embodiment, the valve 60 is disposed between the motor 44 and the fan motor chamber 50. In the present application, the valve 60 is shown located upon the bottom wall 54 of the fan motor chamber 50. However, alternate locations for the valve 60 are contemplated relative to the fan motor chamber 50 which will still be considered "between" the motor 44 and the chamber, provided a unidirectional air or gas flow is enabled during combustion-induced instances of positive pressure through the motor shaft hole 56, while accommodating suspended movement of the motor relative to the motor chamber during the combustion cycle.

Preferably, the one way valve 60 is constructed as a symmetrical single component, made of resilient, chemically resistant elastomer material for permitting the passage of gas pressure from the motor shaft hole 56, but preventing any reverse flow. Additionally, other shapes, materials and compounded component configurations are contemplated. The valve 60 is generally "C"-shaped in cross-section; however in the present application "C"-shaped is to be considered broadly, and includes any curved, arcuate or even wedge-shaped configuration with a joined first portion 62 and a second portion 64 secured along a common edge or central portion 66. Peripheral edges 68 of the first and second portions 62, 64 are referred to as lip seal edges.

The first portion 62 engages the bottom wall 54 and may be secured there by friction fit, mating formations, tongue in groove, suitable chemical adhesives or the like. Alternatively, the first portion may be held in place only by entrapment between the fan motor 44 and the bottom wall 54. During tool assembly, the valve 60 is dropped into the fan motor chamber 50 just prior to installation of the motor 44. A lip seal is the preferred configuration of the second portion 64, which sealingly engages a lower end 70 of the fan motor 44. It will also be seen that the valve 60 defines a central opening 72, dimensioned to provide clearance with the motor shaft 42, thereby not impairing motor performance. A feature of the present valve 60 is that it is constructed and arranged for accommodating suspended sliding action of the motor 44 relative to the fan motor chamber 50.

Figure 4:
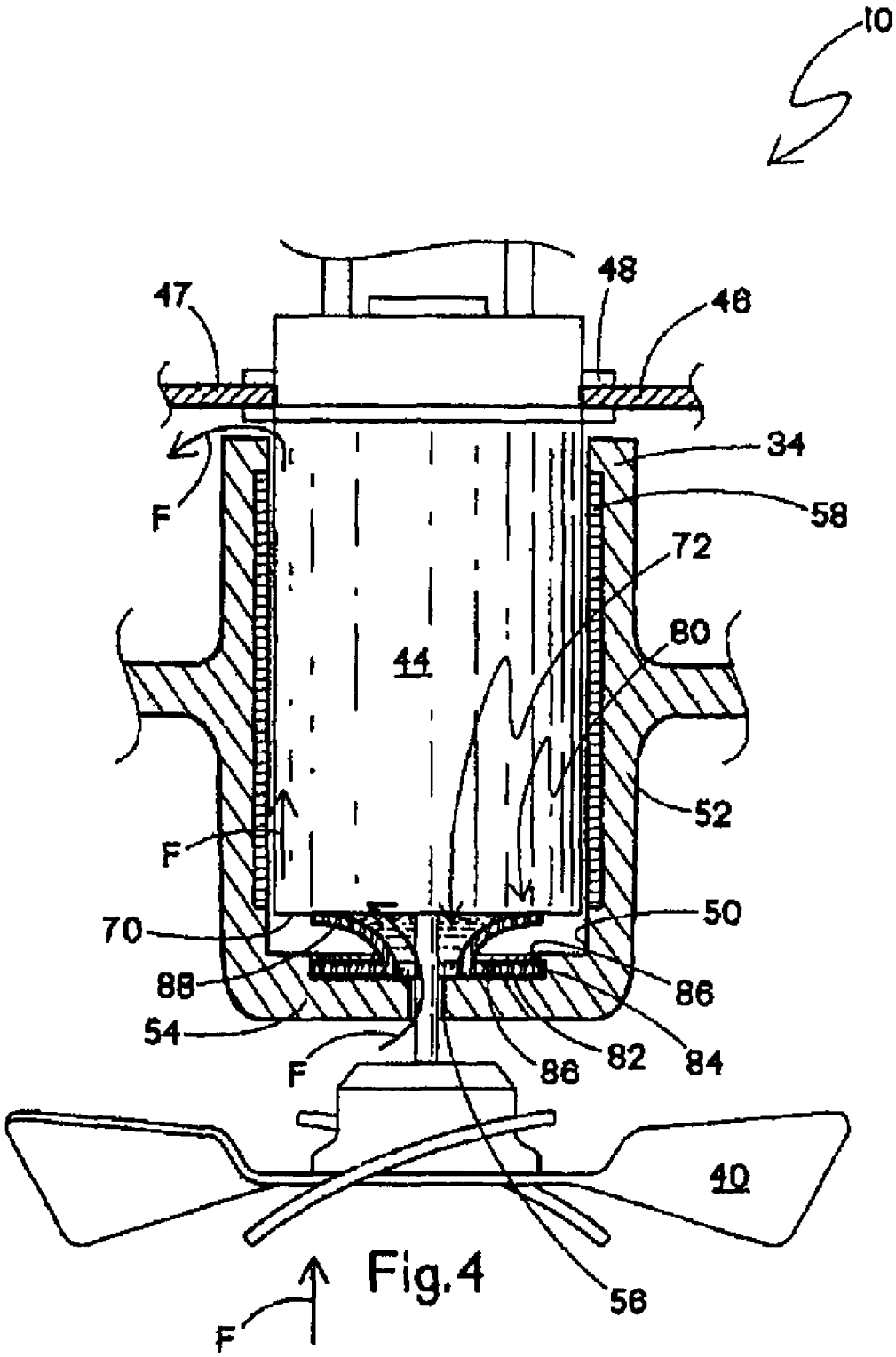
FIG. 4 is a fragmentary vertical section of an alternate embodiment of the present one way valve.

Referring now to FIG. 4, an alternate embodiment of the present valve is generally designated 80. Components shared with the valve 60 are designated with identical reference numbers. A main distinction between the valves 60 and 80 is that the latter is secured at the first portion 82 in a recess 84 in the bottom wall 54 of the fan motor chamber 50. The recess 84 includes a radially inwardly projecting lip 86 which releasably retains the generally planar first portion 82 in position. While a friction fit may satisfactorily retain the first portion 82 which is preferably removable for maintenance purposes, chemical adhesives or other supplemental fastening technologies are contemplated. The second portion 88, forming a lip seal with the lower motor end 70, extends arcuately from an inner edge 90.

Thus, it will be seen that the present nailer includes various embodiments of a one way valve which reduces or eliminates leakage around the motor during the piston return cycle, or when pressure levels are similar to, or lower than atmospheric pressures present in the combustion engine. Also, the valve provides venting around the motor during positive combustion pressures and reduces piston return time due to increased pressure differentials within the combustion power source 14. Further, the above-listed benefits of the present valve permit nailer manufacturers to enlarge the diameter of the motor shaft hole 56 and thus reduce the chance of operational shaft/hole edge contact during relative sliding of the fan motor 44 in the motor chamber 50, thereby improving motor performance characteristics.

While particular embodiments of the present one way valve for a combustion tool fan motor have been described herein, it will be appreciated by those skilled in the art that changes and modifications may be made thereto without departing from the invention in its broader aspects and as set forth in the following claims.

The invention claimed is:

1. A combustion nailer, comprising:

a combustion power source defining a combustion chamber and a fan motor chamber having a bottom wall and at least one sidewall, said bottom wall defining a motor shaft hole;

a fan motor disposed in said fan motor chamber and isolated from the combustion chamber, said fan motor having a first end and a second end, at least said first end being enclosed within said fan motor chamber and having a motor shaft projecting through said motor shaft hole in said bottom wall;

a fan connected to said motor shaft and positioned outside of said fan motor chamber; and a one way valve associated with said fan motor chamber and said motor and configured for allowing unidirectional air flow through said hole past said motor, and preventing air flow in an opposite direction.

2. The nailer of claim 1 wherein said valve is an annular ring.

3. The nailer of claim 2 wherein said valve is generally "C"-shaped in cross-section.

4. The nailer of claim 1 wherein said valve forms a lip seal with a lower end of said motor.

5. The nailer of claim 1 wherein said valve includes a first portion engaging said bottom wall, and a second portion engaging a lower end of said motor.

6. The nailer of claim 5 wherein said first portion is fastened to said bottom wall, and said second portion forms a lip seal with said lower end of said motor.

7. The nailer of claim 1 wherein said tool includes a resilient suspension for said motor for dampening combustion engine-induced shock impact, said valve being constructed and arranged for accommodating suspended sliding action of said motor relative to said fan motor chamber while maintaining a unidirectional sealing relationship with said motor.

8. The nailer of claim 1 wherein said valve defines a central opening in registry with said hole for accommodating said fan motor shaft.

9. The nailer of claim 1 wherein said motor chamber is provided with a sleeve liner for guiding movement of said motor in said motor chamber.

10. The nailer of claim 1 wherein said bottom wall of said chamber includes a recess, and said valve includes a first portion engaged in said recess, and a second portion sealingly engaged with a lower end of said fan motor.

11. The nailer of claim 10 wherein said first portion is removably engaged in said recess.

12. The nailer of claim 1, wherein said valve is positioned between said motor and said bottom wall of said fan motor chamber.

13. A combustion nailer, comprising:

a combustion power source defining a fan motor chamber having at least one chamber wall and a motor shaft hole;

a fan motor disposed in said fan motor chamber and having a motor shaft projecting through said motor shaft hole;

a one way valve associated with said chamber and said motor and forming a lip seal with a lower end of said motor, said valve configured for allowing unidirectional air flow through said hole past said motor, and preventing air flow in an opposite direction.

14. A combustion nailer, comprising:

a combustion power source defining a fan motor chamber having at least one chamber wall and a motor shaft hole;

a fan motor disposed in said fan motor chamber and having a motor shaft projecting through said motor shaft hole;

a one way valve associated with said chamber and said motor and defining a central opening in registry with said hole for accommodating said fan motor shaft, said valve configured for allowing unidirectional air flow through said hole past said motor, and preventing air flow in an opposite direction.

* * * * *